US008297206B2

(12) United States Patent
Meiners

(10) Patent No.: US 8,297,206 B2
(45) **Date of Patent: *Oct. 30, 2012**

(54) STACKABLE, INTERLOCKABLE FURNITURE MODULES

(76) Inventor: Mike Meiners, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/451,857

(22) Filed: Apr. 20, 2012

(65) Prior Publication Data

US 2012/0204769 A1 Aug. 16, 2012

Related U.S. Application Data

(63) Continuation-in-part of application No. 11/716,436, filed on Mar. 9, 2007, now Pat. No. 8,181,581, which is a continuation of application No. 11/714,403, filed on Mar. 6, 2007, now abandoned.

(60) Provisional application No. 60/787,919, filed on Mar. 31, 2006.

(51) Int. Cl.
*A47B 57/00* (2006.01)

(52) U.S. Cl. ..... 108/64; 108/91

(58) Field of Classification Search ..... 108/91, 108/64, 65, 54.1, 56.1, 57.1; 297/232, 243, 297/244, 245

See application file for complete search history.

(56) References Cited

U.S. PATENT DOCUMENTS

| | | | | |
|---|---|---|---|---|
| 2,245,875 | A | 7/1941 | Rutherford | 446/487 |
| 3,347,186 | A | 10/1967 | Khattar | 108/91 |
| 4,789,122 | A | 12/1988 | Gutgsell | 248/188.7 |
| 4,995,668 | A | 2/1991 | Zivari | 297/248 |
| 5,511,851 | A | 4/1996 | Zivari | 297/249 |
| 5,564,345 | A | 10/1996 | Crawford et al. | 108/91 |
| 5,613,448 | A | 3/1997 | Petty | 108/91 |
| 6,068,331 | A | 5/2000 | Barnes | 297/140 |
| 8,181,581 | B2 * | 5/2012 | Meiners | 108/64 |

FOREIGN PATENT DOCUMENTS

| | | |
|---|---|---|
| GB | 601889 | 5/1948 |

* cited by examiner

*Primary Examiner* — Jose V Chen
*Assistant Examiner* — Matthew Ing
(74) *Attorney, Agent, or Firm* — Winston & Strawn LLP

(57) ABSTRACT

A furniture module having a support surface and at least three legs extending therefrom. A first leg is placed adjacent a first edge of the support surface; while two second legs are placed adjacent a second edge of the support surface that is opposite to the first surface edge. The two legs are spaced apart by a distance that is substantially equal to the width of the first leg, and the first leg is spaced apart from the two second legs by a distance that is substantially the same as or greater than the width of the support surface. The outside edges of the first leg are configured for parallel alignment with the inside edges of the second legs to facilitate interlocking of the second legs of one module around the first leg of another module. Multiple modules may be combined to form various furniture designs.

16 Claims, 7 Drawing Sheets

STACKABLE, INTERLOCKABLE FURNITURE MODULES

CROSS-REFERENCE TO RELATED APPLICATIONS

This application is a continuation-in-part of U.S. application Ser. No. 11/716,436 filed Mar. 9, 2007, now U.S. Pat. No. 8,181,581, which is a continuation of U.S. application Ser. No. 11/714,403, filed Mar. 6, 2007, now abandoned, which claims the benefit of U.S. Provisional Application No. 60/787,919, filed Mar. 31, 2006.

BACKGROUND OF THE INVENTION

This invention relates generally to stackable, interlocking furniture. More particularly, this invention concerns the appropriate positioning and spacing of the furniture's structural elements to achieve effective interlocking of multiple modules and efficient use of space when multiple modules are stacked for storage or shipment. Among other uses, individual modules of this invention may be used as a general purpose stool, step ladder, ottoman, bench, bedside table, coffee table, or shelving. Multiple modules can be interlocked end-to-end to form longer single level structures. Multiple modules can be stacked in a variety of configurations to create shelving units or pillars for efficient use of storage space.

U.S. Pat. No. 6,068,331 discloses stackable, nestable articles of furniture including two identical tables and two identical chairs which may be used separately or mated together to form a single cube-like unit. The table units include three legs, one leg extending down from a table surface and having a predetermined width, and the other two legs extending down from the table surface having a space between the legs sized to accommodate the first leg. When assembled into a cube-like unit, the table units are oriented at 180° with respect to each other on the vertical axis and at 180° with respect to each other on the horizontal axis, such that one table surface rests on the ground and the other table surface faces away from the ground. In this orientation, the first leg of one table interlocks with the two legs of the second table and vice versa, created a stacked unit of tables. The associated chairs are similarly designed to nest, within the stacked table unit to form the cube-like unit.

While this prior art illustrates an effective way to stack furniture, it suffers from several problems. First, it does not teach any way to stack more than two table units. In situations where more than two tables are in use, this design would force a user to create multiple cube-like units which are not interconnected. Because additional units are not interconnected, vertical storage would result in a safety risk and side by side storage would limit storage room. Second, the table units of the prior art stack inefficiently, again making it difficult to store a large number of units in a small space. Because the patent discloses stacking the legs of one table upon the legs of the other, the composite cube-like unit is nearly as tall as the height of two tables. Therefore, very little vertical space is saved in this storage configuration. Finally, the system does not provide any means for interlocking the table units while the individual components are arranged for use. Thus, long rows of tables are created only by placing the tables next to each other; there is no means of preventing them from coming out of alignment.

SUMMARY OF THE INVENTION

The present invention solves all of the aforementioned problems of prior art furniture modules. It allows for the stacking of an indefinite number of furniture modules in an efficient manner, while also creating modules capable of interlocking end to end with other modules to create a table or bench-like structure. The modules also can also create stackable, interlocking shelving units.

In particular, the invention relates to a furniture module, comprising a support surface having a thickness and a predetermined width; and at least three legs attached to the surface and extending therefrom in the same direction. A first leg arrangement is placed adjacent a first edge of the surface and has a thickness, outside edges and a predetermined width terminating at the outside edges; while a second leg arrangement of at least two second legs is placed adjacent a second edge of the surface that is opposite to the first surface edge, with the two legs each having a thickness, an inside edge, and being spaced apart by a distance that is substantially equal to the predetermined width of the first leg arrangement. Thus, the first leg arrangement is spaced apart from the at least two second legs by a predetermined distance that is substantially the same as or greater than the width of the support surface; and the outside edges of the first leg arrangement are configured for parallel alignment with the inside edges of the second legs to facilitate interlocking of the at least two second legs of one module around the first leg arrangement of an identical module.

The invention also relates to furniture formed from one or preferably two or more of the modules. Typically, each module is substantially identical in size and shape, with the furniture comprising a first module and a second module situated adjacent the first module wherein the first and second modules cooperate in a number of different ways to form various functional furniture designs and shapes.

BRIEF DESCRIPTION OF DRAWINGS

Other advantages of the invention will become apparent upon reading the following detailed description and upon reference to the associated drawings.

DETAILED DESCRIPTION OF THE INVENTION

Figure 1:
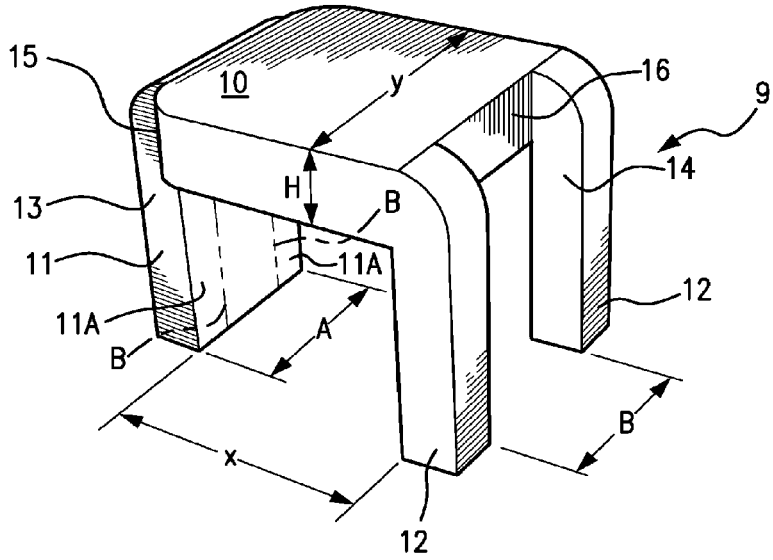
FIG. 1 is an isometric view of an exemplary embodiment for an individual furniture module.

While the invention will be described in connection with a preferred embodiment, it will be understood that it is not intended to limit the invention to this embodiment. On the contrary, it is intended to cover all alternatives, modifications and equivalents as may be included within the spirit and scope of the invention. The present invention is directed to furniture modules capable of being used individually or being interlocked to form shelving, a bench, or other articles. The modules can also be effectively stacked atop each other.

In the description that follows, reference will be made to the orientation of a module by considering the support surface as the top, the first leg as being the back, and the second legs as being the front. Of course, this reference is made for the convenience of understanding this description and not to limit the use of description of the arrangement of the modules in various furniture designs.

Accordingly, in one embodiment, a first module according to the invention can cooperate with another identical module in any of the following ways beginning with first and second modules each resting on a planar surface and with:

(a) the second module situated adjacent to the first module in the direction of the first module's second leg arrangement with the first leg arrangement of the first module disposed adjacent the inside edges of the two second legs, e.g., to form a bench, (b) the second module rotated 180° about an axis extending perpendicular to the surface of its first leg arrangement and situated adjacent to the first module in the direction of the first module's second leg arrangement e.g., to form a component of a shelving unit; or (c) the second module rotated 180° about an axis extending perpendicular to the surface of its first leg arrangement and 180° about an axis extending perpendicular to its primary support surface and situated adjacent to the first module in the direction of the first module's legs e.g., to form a cube-like arrangement; or (d) the second module rotated 180° about an axis extending perpendicular to the primary support surface and situated adjacent to the first module in the direction of the first module's primary support element e.g., to form a stacking unit.

In another embodiment, the modules produce combinations wherein the second module can be situated adjacent to the first module with the first leg arrangement of the second module disposed adjacent the inside edges of the two second legs of the first module; the second module situated adjacent to the first module with the first leg arrangement of the second module disposed adjacent the inside edges of the two second legs of the first module and the first leg arrangement of the first module disposed adjacent the inside edges of the two second legs of the second module; or one of the first module and the second module being situated adjacent another of the first module and the second module with the support surface of either module disposed between the first leg arrangement and the two second legs of the other module. Furthermore, in this embodiment, the second module may be inverted with respect to the first module.

The furniture modules of this invention may be made of any material, including but not limited to woods, composites, wood composites, metals, metal composites and equivalents and combinations thereof. Plastics, metal and woods are preferred because in appropriate types they are light in weight, strong and low in cost. Furthermore, the furniture modules of this invention may be scaled to any size, so long as relevant dimensions described hereafter remain in proportion. Although various modules may, in their final form, appear in different colors and with different design patterns, in the preferred embodiment, all of modules have the same height and shape.

In accordance with the invention, each furniture module 9 is comprised of a preferably square top surface 10, a first set of one or more legs 11, and a second set of at least two legs 12. Both the first set of legs and the second set of legs extend downward from opposing sides of the surface and are preferably offset from the surface edges as illustrated. In the preferred embodiment illustrated in FIG. 1, the surface 10 has a single leg 11 extending downward from one side of the surface 10 and two legs 12 extending downward from the opposite side of the surface 10.

As illustrated in FIG. 1, the first leg 11 has a predetermined width A between its outermost surfaces 13. In another embodiment of the invention also illustrated in FIG. 1, multiple legs 11A designated by dashed lines B could replace the unitary first leg 11. However, in such an embodiment, the predetermined width between the outermost surfaces of the outermost legs must remain A.

Figure 2:
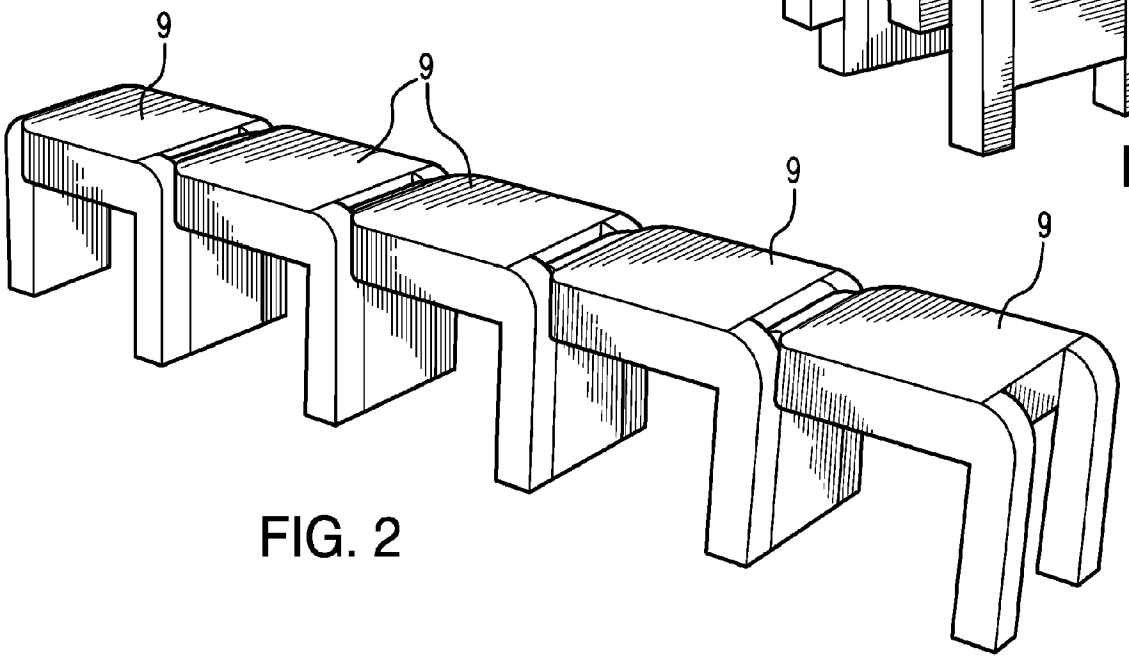
FIG. 2 is an isometric view of several interlocking modules of the type shown in FIG. 1.

Referring back to FIG. 1, the two legs 12 are spaced apart from each other, creating a void of width B between the innermost leg surfaces 14. The width B must be greater than or equal to the predetermined width A in order to accommodate insertion of the first leg 11 at an adjacent but (here) identical module 9 into the void created by the separation of the two legs 12, as illustrated in FIG. 2. Although the preferred embodiment discloses the use of two legs to create the void, any number of legs may be used so long as the width between the innermost surfaces of the innermost legs remains width B.

In the preferred embodiment of FIG. 2, the modules interlock. This is accomplished in the preferred embodiment by protruding the first leg 11 from the surface edge 15 and by protruding the two legs 12 from the surface edge 16, as illustrated in FIG. 1. The protruding first leg 11 of a first module is inserted into the void created by the protruding two legs 12 of a second module, thus preventing lateral movement. Longitudinal movement can be prevented by providing interlocking dovetail formations (not shown) in the leg surfaces 13 and 14.

Alternatively, the invention includes placement of the legs directly underneath the surface, rather than in an offset position. In this embodiment, the legs of a first module (not shown) would be positioned outside or beyond the perimeter of the surface of a second, nested module. This second module would nest within the void between the innermost surfaces of the legs of the first module. This would also result in interlocking modules that prevent lateral movement.

Figure 3:
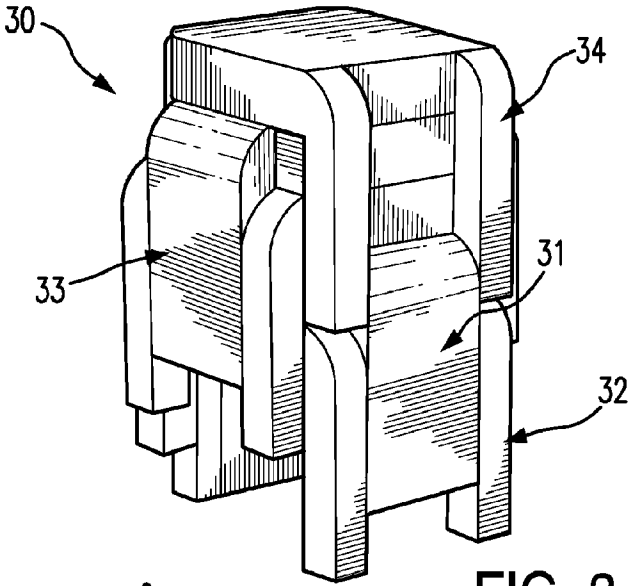
FIG. 3 is an isometric view of several stacked modules of the type shown in FIG. 1.

In accordance with a further aspect of this invention, FIG. 1 illustrates that the space between the first leg 11 and the two legs 12 has a predetermined length X. The maximum width Y of the surface 10 is less than or equal to the predetermined length X. As shown in FIG. 3, this spacing permits the stacking of a first module 31 upon a second module 32, with the first module 31 oriented at 180° with respect to the second module 32. This arrangement increases the height of the combined structure by only the height H of the surface 10 and thus maximizes storage space. As further illustrated in FIG. 3, by orienting a third module 33 at 90° in either direction with respect to the second module 32, the third module 33 may be stacked upon the second module 32. In addition, by stacking a fourth module oriented at 180° in either direction with respect to the third module 33, a stacking unit 30 is created. The entire configuration can be locked in place by placing a fifth module atop the stack, as illustrated in FIG. 3. Repetition of this process permits the stacking of an indefinite number of furniture modules.

Figures 4, 5:
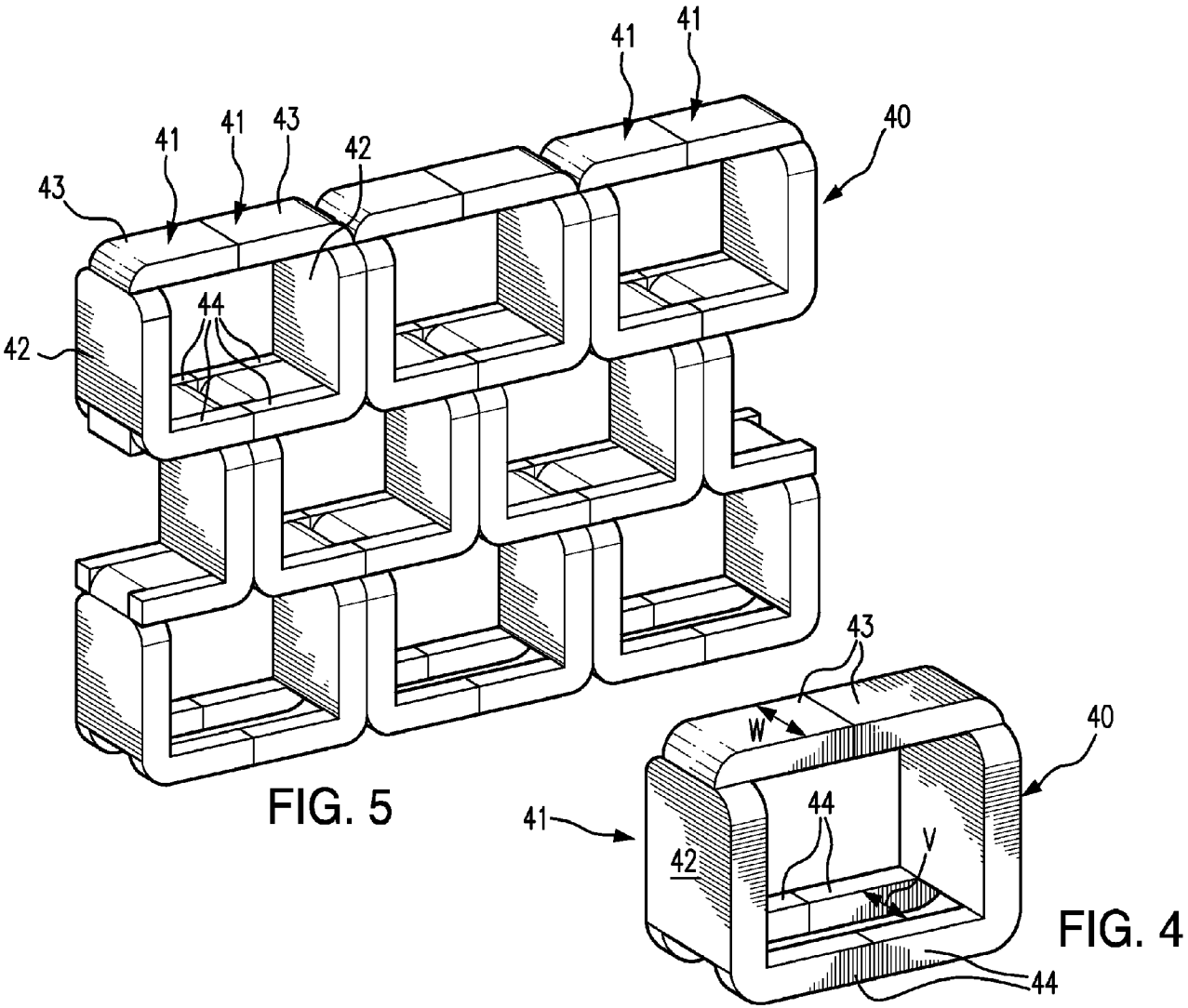
FIG. 4 is an isometric view of an exemplary embodiment of a shelving unit using modules of the type shown in FIG. 1.
FIG. 5 is an isometric view of an exemplary for the shelving units of FIG. 4 stacked atop and interlocked with each other.

FIG. 4 illustrates an embodiment of yet another aspect of this invention. FIG. 4 depicts an embodiment of a shelving unit 40 created through the combination of two identical shelf modules 41. These modules 41 are identical in configuration with the modules in FIGS. 1-3. Each shelf module 41 includes a side surface 42, a top leg 43, and two bottom legs 44. The top leg 43 and the bottom legs 44 extend perpendicularly to the side surface 42 in the same direction. The top leg 43 is designed with a predetermined width W. The bottom legs 44 are spaced apart so that the width between the innermost surfaces of the two legs is V, a distance greater than or equal to the predetermined width W.

As seen in FIG. 5, the spacing is such that the top leg 53 of one shelf module 51 will nest within the space between the bottom legs 54 of a second shelf module 52, effectively interlocking shelf module 51 and shelf module 52.

The shelf modules of FIG. 4 are configured and oriented so that the top legs 43 and the bottom legs 44 of two shelf modules 41 confront each other. The combination of the two shelf modules in this orientation constitutes a shelving unit. Although the shelving unit depicted in FIG. 4 is the preferred embodiment, multiple variations can be created. As an example, any number of legs may be used as a substitute for the top leg or the bottom legs, so long as the space between the innermost surfaces of the innermost bottom legs remains greater than or equal to the width of the outermost opposing surfaces of the outermost top legs. Aside from this spacing limitation, the shelving units 41 may come in any size or shape. However, each shelf module 41 must be substantially identical in size and shape when compared to the other modules.

Figure 6:
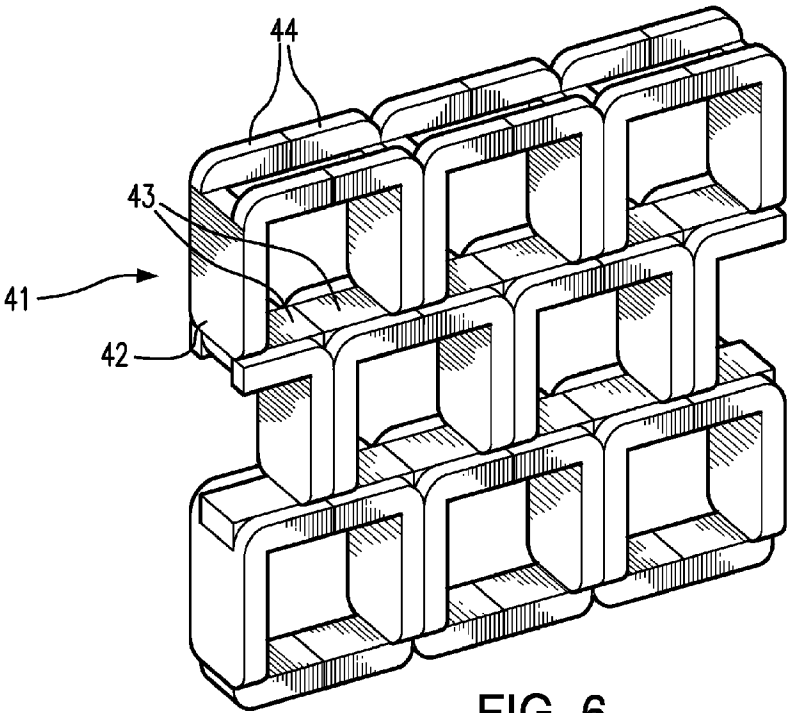
FIG. 6 is an isometric view of another exemplary configuration for the shelving units of FIG. 4 stacked atop and interlocked with each other.

The shelving units of FIG. 4 can be combined into a variety of structures, some of which are illustrated in FIGS. 5 and 6. To accomplish this, all shelving units and shelf modules used to create the shelving structure are oriented in the same direction. The shelving units should be oriented so that at least one flat surface of the shelving unit is parallel to the ground. As illustrated in FIG. 5, each shelving unit 41 is oriented such that the top legs 43 face down and the bottom legs 44 face up. A number of shelving units are placed side by side so that the side surface 42 of one shelving unit 43 abuts the side surface 42 of another shelving unit 41. Another second-level shelving unit 41 may be placed atop the ground level shelving units 41 just described. The second-level shelving unit 41 is centered above the point where the side surfaces 42 of the ground level shelving units 41 meet. The top legs 43 of the second-level shelving unit 42 nest within the space created by the bottom legs 44 of the ground level shelving units 41, interlock all of the shelving units and preventing lateral movement. Due to this spacing, it is necessary to fill out the second level with a single shelf module 41 at each end. As before, the side surface 42 of the shelf module 41 abuts the side surface 42 of the adjacent shelving unit 41 and the top leg 43 of the shelf module 41 interlocks with the bottom legs 44 of the ground level shelving unit. By repeating this process, a shelving structure of indefinite length and height can be achieved.

The same approach may be used by rotating the shelving units and shelf modules in any direction, so long as one surface remains parallel to the ground. In the further embodiment of FIG. 6, the same approach is used, however the shelving units 11 are oriented such that the top legs 44 face up and the bottom legs 43 facedown.

FIGS. 7 to 12 show examples of pairs of modules 9 forming arrangements wherein the outside edges of the first leg 11 are configured for parallel alignment with the inside edges of the second legs 12. Although the modules to be combined are not limited to the examples as shown and described herein, these examples demonstrate the versatility of module 9 to facilitate interlocking of the second legs of one module around the first leg of another module to form a load bearing structure.

Figure 7:
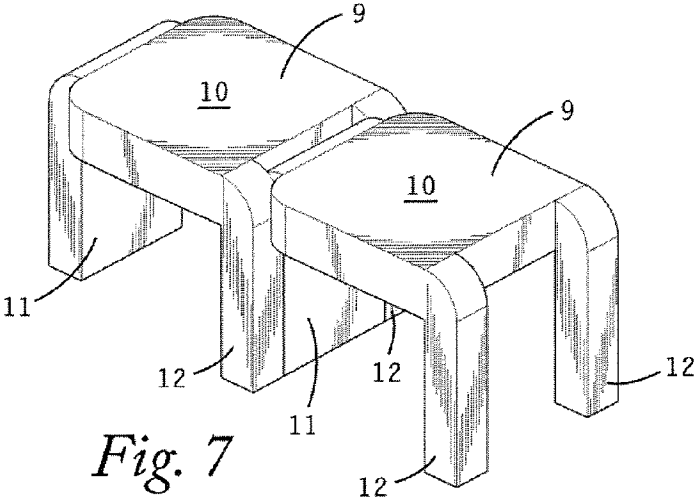
FIG. 7 and FIG. 8 are isometric views of exemplary configurations for a pair of interlocked modules of the type shown in FIG. 1.
Figure 8:
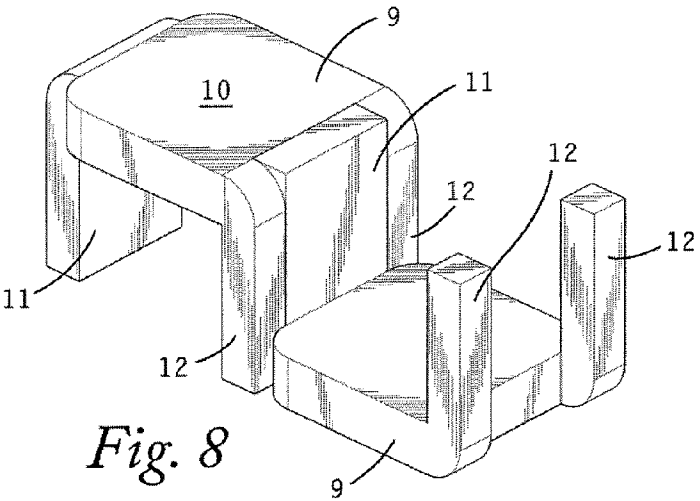

FIGS. 7 and 8 show examples of pairs of interlocked modules 9 of the type shown in FIG. 1. FIG. 7 shows a pair of interlocked modules 9, each in an upright orientation with the surface 10 facing upward and first leg 11 and the two legs 12 depending downward therefrom. In FIG. 8, one module remains in an upright orientation while a second module is inverted such that surface 10 faces downward relative to a support surface with the first leg 11 and the two legs 12 depending upwardly therefrom. In each example, the offset first leg 11 of a first module 9 is inserted into the void created by the offset two legs 12 of a second module 9, thus providing an arrangement of consecutively interlocked modules that resist lateral movement relative to one another.

Figure 9:
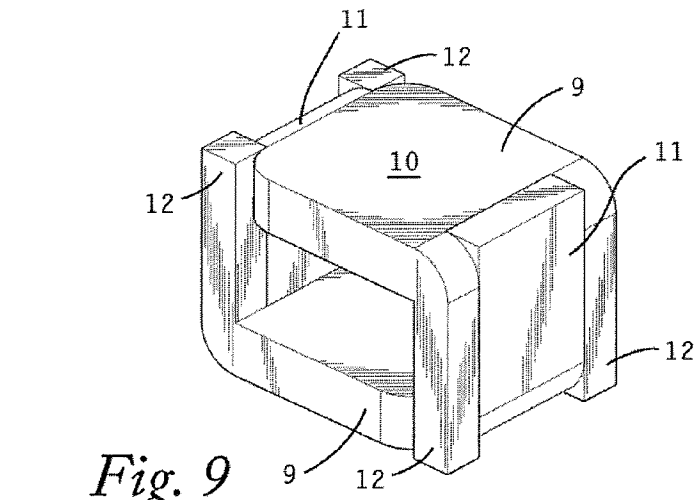
FIG. 9 and FIG. 10 are isometric views of exemplary configurations for a pair of stacked interlocked modules of the type shown in FIG. 1.
Figure 10:
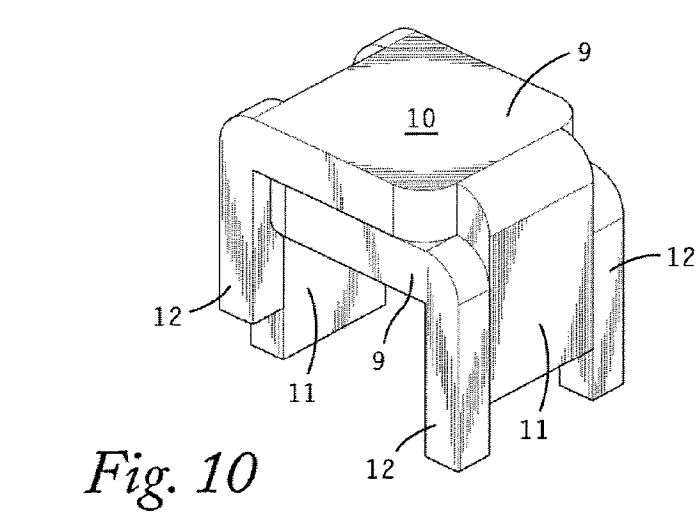

FIGS. 9 and 10 show examples of pairs of stacked interlocked modules of the type shown in FIG. 1. FIG. 9 shows a pair of stacked interlocked modules 9 wherein a first module is provided in an upright orientation (with the surface 10 facing upward and first leg 11 and the two legs 12 depending downwardly therefrom) and a second module is inverted (such that surface 10 faces downward parallel to a surface with the first leg 11 and the two legs 12 depending upwardly therefrom). FIG. 10 shows a pair of stacked interlocked modules wherein both modules 9 are provided in an upright orientation with surface 10 facing upward and first leg 11 and the two legs 12 depending downwardly therefrom. In this example, one module (the "upper module") is placed atop the second module ("the lower module") such that the surface 10 of the lower module supports the upper module thereby. In both examples, the first leg 11 of each module 9 is inserted into the void created by the offset two legs 12 of the other module 9, thus providing an arrangement of stacked interlocked modules that resist later movement relative to one another.

Figure 12:
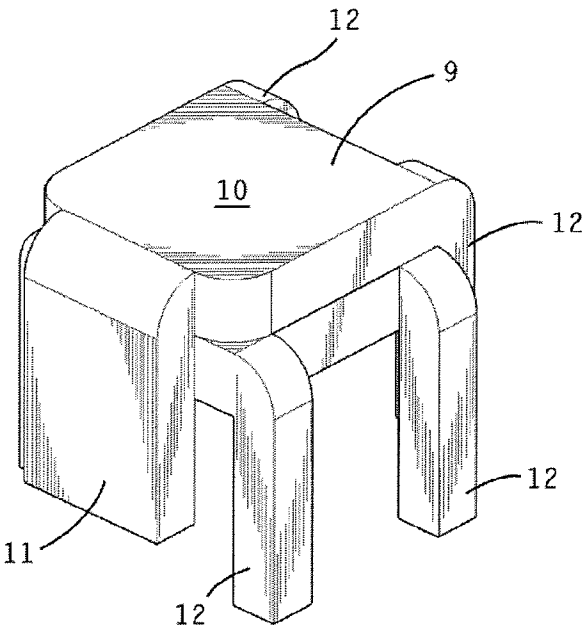
FIG. 11 and FIG. 12 are isometric views of exemplary configurations for a pair of stacked modules of the type shown in FIG. 1.
Figure 11:
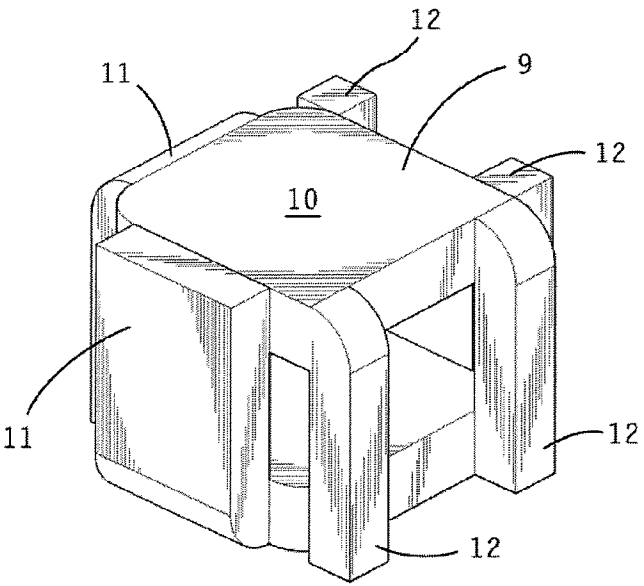

FIGS. 11 and 12 show examples of pairs of stacked modules of the type shown in FIG. 1. FIG. 11 shows a pair of stacked modules 9 wherein a first module is provided in an upright orientation (with the surface 10 facing upward and first leg 11 and the two legs 12 depending downwardly therefrom) and a second module is inverted (such that surface 10 faces downward parallel to a surface with the first leg 11 and the two legs 12 depending upwardly therefrom). FIG. 12 shows a pair of stacked modules wherein both modules 9 are provided in an upright orientation with surface 10 facing upward and first leg 11 and the two legs 12 depending downwardly therefrom. In this example, one module (the "upper module") is placed atop another module ("the lower module") such that the surface 10 of the lower module supports the upper module thereby. In both examples, the surface 10 is inserted into the void created by the space between the first leg 11 and the two legs 12, thus providing an arrangement of stacked modules that resist later movement relative to one another.

FIGS. 13*a* to 13*d* show examples of module 9 in different orientations forming arrangements wherein module 9 serves as a support surface or a base for an object such as a tabletop or other surface. Although the implementation of module 9 is not limited to that of a support or base as shown and described herein, these examples demonstrate the versatility of module 9 to serve as a load bearing structure by itself.

Figure 13:
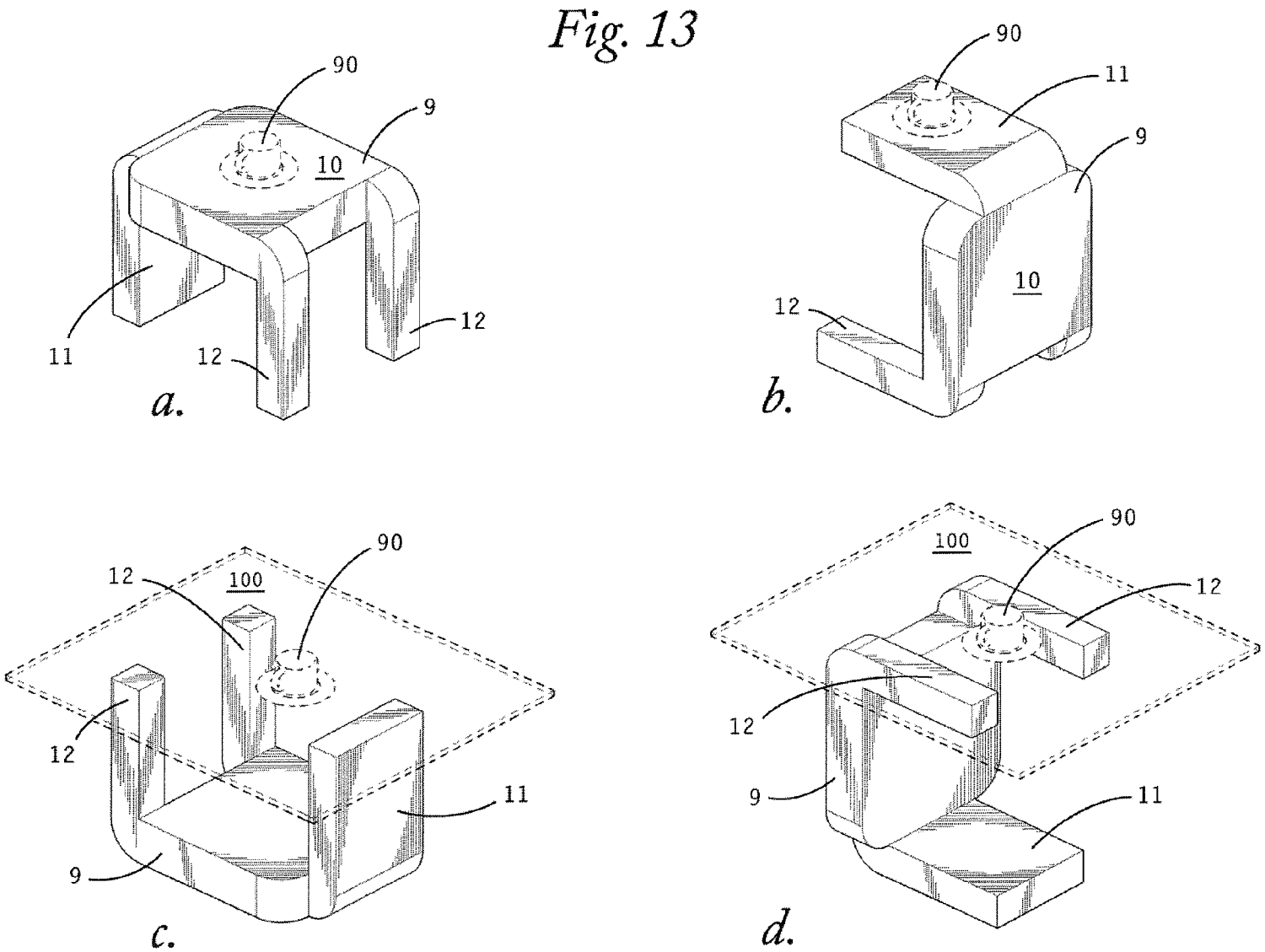
FIGS. 13*a*, 13*b*, 13*c* and 13*d* are isometric views of the module of FIG. 1 in use as a base having respective upright, clockwise rotated, inverted and counterclockwise rotated orientations.

Each of FIGS. 13*a* and 13*b* shows a single module 9 of the type shown in FIG. 1 serving as a support surface for an object such as coffee cup 90 (although coffee cup 90 is shown, it is understood that module 9 may support any amenable object, animal and/or person). FIG. 13*a* shows module 9 in an upright orientation with the surface 10 facing upward and first leg 11 and the two legs 12 depending downward therefrom. In this example, surface 10 supports coffee cup 90 thereby. FIG. 13*b* shows module 9 rotated 90° clockwise relative to the upright position shown in FIG. 13*a* such that surface 10 is sideward facing with first leg 11 and the two legs 12 extending outwardly relative thereto. The two legs 12 are parallel with a support surface to support module 9 thereon and also with first leg 11, which supports coffee cup 90 thereby. In both examples, module 9 may serve as a functional and/or ornamental piece, such as a table, chair, plant stand or foot rest or in any other manner amenable to practice of the invention as shown and described herein.

Each of FIGS. 13*c* and 13*d* shows a single module 9 of the type shown in FIG. 1 serving as a base for another support surface such as table top 100 (shown herein supporting coffee cup 90 thereon, although it is understood that table top 100 may support any other object thereon). FIG. 13*c* shows module 9 in an inverted orientation with the surface 10 in parallel with and supported by a surface with first leg 11 and the two legs 12 depending upwardly therefrom. In this example, the free extents of first leg 11 and the two legs 12 support table top 100 thereby. FIG. 13*d* shows module 9 rotated 90° clockwise relative to the inverted position shown in FIG. 13*c* (or, alternatively, 90° counterclockwise relative to the upright position shown in FIG. 13*a*) such that surface 10 is sideward facing with first leg 11 and the two legs 12 extending outwardly relative thereto. The first leg is parallel with a support surface to support module 9 thereon and also with the two legs 12, which support table top 100 thereby. It is understood that module 9 in the orientations shown in FIGS. 13*a* and 13*b* may also support table top 100 or a similar or complementary surface (for instance, by placing table top 100 upon surface 10 of the module shown in FIG. 13*a* or upon first leg 11 of the module shown in FIG. 13*b*). It is understood that table top 100 is an optional feature and that the modules shown in FIGS. 13*c* and 13*d* may serve as functional and/or ornamental pieces on their own.

Although the preferred embodiments illustrated in the drawings show generally rectangular geometries, the invention comprehends any shaped surface that permits attachment of the required leg structures. Furthermore, except where otherwise required, the legs need not be perpendicular to the surface, but may extend from the surface at any angle so long as the required proportional dimensions are not violated.

The numerical values disclosed herein are not to be understood as being strictly limited to the exact values recited. Instead, unless otherwise specified, each such value is intended to mean both the recited value and a functionally equivalent range surrounding that value as well as equivalent units of that value.

Every document cited herein, including any cross-referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While the invention has been described in a preferred form, it will be understood that changes, additions, and modifications may be made to the respective articles forming the invention. Accordingly, no limitation should be imposed on the scope of this invention, except as set forth in the accompanying claims.

What is claimed is:

1. A furniture module, comprising:

a support surface having a thickness and a predetermined width;

at least three legs attached to the surface and extending therefrom in the same direction, with:

a first leg arrangement placed adjacent a first edge of the surface and having a thickness, outside edges and a predetermined width terminating at the outside edges; and a second leg arrangement of at least two second legs placed adjacent a second edge of the surface that is opposite to the first surface edge, with the two legs each having a thickness and an inside edge, with the two second legs spaced apart by a distance that is substantially equal to the predetermined width of the first leg arrangement;

wherein the first leg arrangement is spaced apart from the at least two second legs by a predetermined distance that is substantially the same as or greater than the width of the support surface; and wherein the outside edges of the first leg arrangement are configured for parallel alignment with the inside edges of the second legs to facilitate interlocking of the at least two second legs of one module around the first leg arrangement of an identical module.

2. The furniture module of claim 1 in which to make furniture the module cooperates with another identical module in any of the following ways beginning with first and second modules each resting on a planar surface and with:

(a) the second module situated adjacent to the first module in the direction of the first module's second leg arrangement with the first leg arrangement of the first module disposed adjacent the inside edges of the two second legs, (b) the second module rotated 180° about an axis extending perpendicular to the surface of its first leg arrangement and situated adjacent to the first module in the direction of the first module's second leg arrangement, or (c) the second module rotated 180° about an axis extending perpendicular to the surface of its first leg arrangement and 180° about an axis extending perpendicular to its primary support surface and situated adjacent to the first module in the direction of the first module's legs; or (d) the second module rotated 180° about an axis extending perpendicular to the primary support surface and situated adjacent to the first module in the direction of the first module's primary support element.

3. The furniture module of claim 1, in which the module is oriented in any of the following positions with:

(a) the module in an upright orientation with the support surface facing upward and the first leg arrangement and the two second legs depending downwardly therefrom;

(b) the module in an inverted orientation with the support surface facing downward and with the first leg arrangement and the two second legs depending upwardly therefrom; or (c) the module rotated:

i. 90° clockwise relative to a module oriented as in the upright orientation when viewing a side of the module; or ii. 90° counterclockwise relative to a module oriented as in the upright orientation when viewing a side of the module.

4. The furniture module of claim 3, wherein one of the first leg arrangement and the second leg arrangement rests on a planar surface and another of the first leg arrangement and the second leg arrangement functions as a support.

5. The furniture module of claim 1, wherein the thickness of the first leg arrangement is substantially the same as the thickness of the at least two second legs.

6. The furniture module of claim 1, wherein the module is composed of a material selected from woods, composites, wood composites, metals, metal composites and any equivalents and combinations thereof.

7. The furniture module of claim 1, wherein the module is of preformed, unitary construction.

8. The furniture module of claim 1, wherein the support surface is substantially rectangular and the legs extend from edges of the support surface.

9. The furniture module of claim 8, wherein the legs include a smooth transition between the support surface and the sides of the legs.

10. The furniture module of claim 1, wherein at least one of the first leg arrangement and the second leg arrangement is arranged to be perpendicular to the support surface.

11. The furniture module of claim 1, wherein the first leg arrangement includes multiple legs with the width extending to the outside edges of the outermost legs.

12. The furniture module of claim 1, wherein in each module a plurality of second legs are included, with the spacing of the inside edges of the innermost legs being substantially the same as the width of the first leg arrangement.

13. A stackable, interlockable furniture module, comprising:

a support surface having a thickness and predetermined width;

at least three legs attached to the surface and extending therefrom in the same direction, with:

a first leg arrangement placed adjacent a first edge of the surface and having a thickness, outside edges and a predetermined width terminating at the outside edges; and an arrangement of at least two second legs placed adjacent a second edge of the surface that is opposite to the first surface edge, with the two legs each having a thickness and an inside edge, with the two second legs spaced apart by a distance that is substantially equal to the predetermined width of the first leg arrangement, wherein the outside edges of the first leg arrangement are configured for parallel alignment with the inside edges of the second legs to facilitate interlocking of the at least two second legs of one module around the first leg arrangement of an identical module;

wherein the first leg arrangement is spaced apart from the at least two second legs by a predetermined distance that is substantially the same as or greater than the width of the supporting surface; and wherein the module cooperates with the identical module in any of the following ways beginning with first and second modules each resting on a planar surface and with:

(a) the second module situated adjacent to the first module in the direction of the first module's second leg arrangement with the first leg arrangement of the first module disposed adjacent the inside edges of the two second legs, (b) the second module rotated 180° about an axis extending perpendicular to the surface of its first leg arrangement and situated adjacent to the first module in the direction of the first module's second leg arrangement, or (c) the second module rotated 180° about an axis extending perpendicular to the surface of its first leg arrangement and 180° about an axis extending perpendicular to its primary support surface and situated adjacent to the first module in the direction of the first module's legs; or (d) the second module rotated 180° about an axis extending perpendicular to the primary support surface and situated adjacent to the first module in the direction of the first module's primary support element.

14. A stackable, interlockable furniture module, comprising:

a support surface having a thickness and predetermined width;

at least three legs attached to the surface and extending therefrom in the same direction, with:

a first leg arrangement placed adjacent a first edge of the surface and having a thickness, outside edges and a predetermined width terminating at the outside edges; and an arrangement of at least two second legs placed adjacent a second edge of the surface that is opposite to the first surface edge, with the two legs each having a thickness and an inside edge, with the two second legs spaced apart by a distance that is substantially equal to the predetermined width of the first leg arrangement, wherein the outside edges of the first leg arrangement are configured for parallel alignment with the inside edges of the second legs to facilitate interlocking of the at least two second legs of one module around the first leg arrangement of an identical module;

wherein the first leg arrangement is spaced apart from the at least two second legs by a predetermined distance that is substantially the same as or greater than the width of the supporting surface; and wherein the module is oriented in any of the following positions with:

(a) the module in an upright orientation with the support surface facing upward and the first leg arrangement and the two second legs depending downward therefrom;

(b) the module in an inverted orientation with the support surface facing downward and with the first leg arrangement and the two second legs depending upwardly therefrom; or (c) the module rotated:

i. 90° clockwise relative to a module oriented as in the upright orientation when viewing a side of the module; or ii. 90° counterclockwise relative to a module oriented as in the upright orientation when viewing a side of the module;

such that the support surface is sideward facing with the first leg arrangement and the two second legs extend outwardly relative thereto.

15. Furniture comprising a pair of stackable, interlockable modules according to claim 1, each module being substantially identical in size and shape, the furniture comprising:

a first module;

a second module situated adjacent the first module wherein the first and second modules cooperate in any of the following ways beginning with first and second modules each resting on a planar surface and with:

(a) the second module situated adjacent to the first module in the direction of the first module's second leg arrangement with the first leg arrangement of the first module disposed adjacent the inside edges of the two second legs, (b) the second module rotated 180° about an axis extending perpendicular to the surface of its first leg arrangement and situated adjacent to the first module in the direction of the first module's second leg arrangement, or (c) the second module rotated 180° about an axis extending perpendicular to the surface of its first leg arrangement and 180° about an axis extending perpendicular to its primary support surface and situated adjacent to the first module in the direction of the first module's legs; or (d) the second module rotated 180° about an axis extending perpendicular to the primary support surface and situated adjacent to the first module in the direction of the first module's primary support element to form a stacking unit.

16. Furniture according to claim 15, wherein the first leg arrangement is spaced apart from the at least two second legs by a predetermined distance that is substantially the same as the width of the supporting surface.

* * * * *